US010568488B2

(12) United States Patent
Heisele et al.

(10) Patent No.: US 10,568,488 B2
(45) Date of Patent: Feb. 25, 2020

(54) SPRAY ARM AND DISHWASHER

(71) Applicant: BSH Hausgeräte GmbH, Munich (DE)

(72) Inventors: Bernd Heisele, Sontheim (DE); Anton Oblinger, Wertingen (DE)

(73) Assignee: BSH Hausgeräte GmbH, Munich (DE)

( * ) Notice: Subject to any disclaimer, the term of this patent is extended or adjusted under 35 U.S.C. 154(b) by 41 days.

(21) Appl. No.: 15/564,763

(22) PCT Filed: Mar. 30, 2016

(86) PCT No.: PCT/EP2016/056843
§ 371 (c)(1),
(2) Date: Oct. 6, 2017

(87) PCT Pub. No.: WO2016/169737
PCT Pub. Date: Oct. 27, 2016

(65) Prior Publication Data

US 2018/0110394 A1 Apr. 26, 2018

(30) Foreign Application Priority Data

Apr. 24, 2015 (DE) ..... 10 2015 207 582

(51) Int. Cl.

| | |
|---|---|
| ***A47L 15/23*** | (2006.01) |
| ***A47L 15/22*** | (2006.01) |
| ***A47L 15/42*** | (2006.01) |
| ***A47L 15/50*** | (2006.01) |

(52) U.S. Cl.
CPC ..... *A47L 15/22* (2013.01); *A47L 15/23* (2013.01); *A47L 15/4217* (2013.01); *A47L 15/4278* (2013.01); *A47L 15/502* (2013.01)

(58) Field of Classification Search
None
See application file for complete search history.

(56) References Cited

U.S. PATENT DOCUMENTS

| | | | | |
|---|---|---|---|---|
| 3,776,465 | A | 12/1973 | Baker | |
| 2008/0173338 | A1 | 7/2008 | Kim et al. | |
| 2014/0083470 | A1* | 3/2014 | Kim | A47L 15/428 134/183 |

FOREIGN PATENT DOCUMENTS

| | | | |
|---|---|---|---|
| CN | 201198592 | Y | 2/2009 |
| CN | 102940475 | A | 2/2013 |
| DE | 3534755 | A1 | 4/1987 |
| DE | 8609946 | U1 | 8/1987 |

(Continued)

OTHER PUBLICATIONS

Espacenet translation DE3631555, Dishwasher with a spray arm, 1988 (Year: 1988).*

(Continued)

*Primary Examiner* — Cristi J Tate-Sims
(74) *Attorney, Agent, or Firm* — Michael E. Tschupp; Andre Pallapies; Brandon G. Braun

(57) ABSTRACT

A spray arm for a dishwasher includes an outlet nozzle which is provided on a bottom side of the spray arm for emptying washing liquor from the spray arm. The outlet nozzle is selectively closed and opened by a valve which is movable from an open position into a closed position in response to a pressure of the washing liquor. The valve is pretensioned in a direction to seek the open position so that the valve automatically opens when the pressure of the washing liquor drops below a predetermined value.

22 Claims, 4 Drawing Sheets

(56) References Cited

FOREIGN PATENT DOCUMENTS

| | | |
|---|---|---|
| DE | 3631555 A1 | 3/1988 |
| EP | 2891446 B1 | 5/2017 |

OTHER PUBLICATIONS

National Search Report DE 10 2015 207 582.6 dated Feb. 1, 2016.
International Search Report PCT/EP2016/056843 dated May 24, 2016.
National Search Report CN 2016800234196 dated May 29, 2019.

* cited by examiner

SPRAY ARM AND DISHWASHER

CROSS-REFERENCES TO RELATED APPLICATIONS

This application is the U.S. National Stage of International Application No. PCT/EP2016/056843, filed Mar. 30, 2016, which designated the United States and has been published as International Publication No. WO 2016/169737 A1 and which claims the priority of German Patent Application, Serial No. 10 2015 207 582.6, filed Apr. 24, 2015, pursuant to 35 U.S.C. 119(a)-(d).

BACKGROUND OF THE INVENTION

The present invention relates to a spray arm for a dishwasher and to a dishwasher with a spray arm of this type.

A dishwasher can have a spray arm for applying washing liquor to items to be washed, said spray arm distributing the washing liquor in the inside of a dishwasher cavity of the dishwasher. These spray arms are typically mounted rotatably; however dishwashers with fixed spray arms are also known. In order to prevent the washing liquor from transferring from one wash segment to the next, for instance from the pre-wash segment into the cleaning segment, an outlet nozzle can be provided on the bottom side of the spray arm. To ensure as effective an emptying of the spray arm as possible, it is necessary to configure the diameter of the outlet nozzle to be as large as possible. Maximizing a diameter of the outlet nozzle however results in the pressure of the washing liquor at the cleaning spray nozzles of the spray arm reducing, as a result of which the cleaning performance of the dishwasher can be reduced.

BRIEF SUMMARY OF THE INVENTION

Against this background, one object of the present invention consists in making available an improved spray arm.

In accordance with the invention, a spray arm for a dishwasher is proposed. The spray arm comprises an outlet nozzle, provided on the bottom side of the spray arm, for emptying washing liquor from the spray arm, a valve for selectively closing or opening the outlet nozzle, wherein the valve can be moved from an open position into a closed position with the aid of a pressure of the washing liquor and wherein the valve is pretensioned in the direction of the open position so that the valve automatically opens when the pressure of the washing liquor drops below a predetermined value.

The sizing of the outlet nozzle is thus no longer necessarily a compromise between the rapid emptying of the spray arm and as minimal a loss of pressure of washing liquor as possible. As a result of the valve being provided on the outlet nozzle, compared with known solutions, the outlet nozzle can be significantly larger. This ensures an improved and more rapid emptying of the spray arm. A transfer of washing liquor or waste water from one wash segment of a wash cycle into the next is prevented or at least reduced. The valve can be spring-pretensioned in the direction of the open position. In the closed position, the valve can be entirely closed or a cross-section of the outlet nozzle can be reduced in size compared with the open position of the valve. In other words, in the closed position washing liquor can also still escape from the outlet nozzle.

The spray arm preferably has cleaning spray nozzles arranged on the top side. The spray arm can also have cleaning spray nozzles arranged on the bottom side. The spray arm is preferably an upper or lower spray arm of the dishwasher. The spray arm can be arranged between an upper receptacle and a lower receptacle for items to be washed in the dishwasher. The spray arm is preferably fastened rotatably on an upper spray arm assembly. The upper spray arm assembly can be fastened to the upper receptacle for items to be washed. With the aid of a coupling, the upper spray arm assembly can be fluidically connected to a supply pipe of the dishwasher. The outlet nozzle can be arranged in the region of or adjacent to an axis of rotation or a mounting surface of the spray arm. Furthermore, the outlet nozzle can be provided on an end segment of the spray arm. In particular, the outlet nozzle is provided on a lowest point of the spray arm.

Washing liquor is preferably applied to the spray arm with the aid of a pump. The valve preferably opens automatically as soon as the pump is no longer applying washing liquor to the spray arm. The predetermined value can be between 0.5 and 0 bar for instance. The washing liquor preferably applies force onto the valve, said force acting against a counter force generated by the pretension, in particular by the spring pretension, of the valve. The valve closes as soon as the force exerted by the washing liquor is greater than the counteracting force of the valve. The valve opens automatically as soon as the reset force of the valve is greater than the force applied by the washing liquor onto the valve. The spring force or reset force of the valve results from the inherent rigidity of the material of the valve. Alternatively, a dedicated spring element can be provided for generating the reset force.

According to a further embodiment, the valve comprises a plate-shaped valve body.

The valve body may be rectangular or circular. The valve body is connected to a wall of the spray arm in particular with the aid of a hinge. The hinge can be part of the valve body.

According to a further embodiment, in the open position the plate-shaped valve body is arranged obliquely to a wall of the spray arm.

In particular, in the open position the valve body is arranged obliquely to an inflow direction of the washing liquor in the spray arm. In this way the washing liquor is able to apply a force onto the valve body. For instance, the valve body can be positioned at an oblique angle to the wall. The angle can have a value between 10° and 45°, further preferably between 15° and 40°, further preferably between 20° and 35°.

According to a further embodiment, the plate-shaped valve body points in the direction of an end segment of the spray arm.

This prevents the washing liquor from flowing below the valve body and pressing onto the valve.

According to a further embodiment, the valve is embodied integrally with the spray arm.

The spray arm and the valve can be embodied as a plastic injection-molded component. For instance, the spray arm and the valve can be manufactured from polypropylene (PP). The valve body is preferably connected to the wall of the spray arm with the aid of a hinge.

According to a further embodiment, the valve has a film hinge.

By means of the thickness of the film hinge, it is possible to adjust the level of pretensioning for pretensioning the valve body in the direction of the open position.

According to a further embodiment, the valve and the spray arm are multi-part.

In particular, the valve is inserted into the outlet nozzle. Furthermore, the valve can be coated with the material of the spray arm. The valve can be manufactured from a silicon material for instance. This allows particularly good sealing properties of the valve to be achieved. Alternatively, the valve or the valve body can be manufactured from a metallic material. The valve body can be a leaf spring.

According to a further embodiment, a base segment of the valve is snapped into the spray arm.

This makes possible a particularly simple and rapid assembly of the valve on the outlet nozzle. In particular, the base segment has an anti-twist element which prevents the base segment from twisting in the outlet nozzle. This ensures the functionality of the valve on a long-term basis.

According to a further embodiment, the spray arm has two outlet nozzles, each of which has a valve.

The outlet nozzles can be provided on both sides of an axis of rotation of the spray arm for instance. Furthermore, an outlet nozzle can be provided in the region of the axis of rotation and a further outlet nozzle can be provided in the region of an end segment of the spray arm. Furthermore, the spray arm can also have three or more such outlet nozzles. The outlet nozzle preferably has a diameter of greater than 3 mm. In particular, the outlet nozzle has a diameter of 4 to 7 mm, further preferably of 4.5 to 6.5 mm, further preferably of 5 to 6 mm.

According to a further embodiment, the outlet nozzle is at least partially closed in the closed position of the valve.

Alternatively, the outlet nozzle can be completely closed in the closed position of the valve.

Furthermore, a dishwasher with a spray arm of this type is proposed.

The dishwasher is in particular a domestic dishwasher. The dishwasher has a dishwasher cavity, which can preferably be enclosed in a water-tight manner by a door. A number of receptacles for items to be washed can be provided in the dishwasher cavity. In particular, an upper receptacle for items to be washed and a lower receptacle for items to be washed can be provided in the dishwasher cavity, wherein the spray arm is preferably arranged between the receptacles for items to be washed. A supply pipe of the spray arm can be fastened on the upper receptacle for items to be washed.

Further possible implementations of the spray arm and/or of the dishwasher also comprise combinations—not explicitly cited—of features or embodiments described above or below in respect of the exemplary embodiments. In such cases the person skilled in the art will also add individual aspects as improvements or amendments to the respective basic form of the spray arm and/or of the dishwasher.

BRIEF DESCRIPTION OF THE DRAWINGS

Further advantageous embodiments and aspects of the spray arm and/or of the dishwasher form the subject matter of the subclaims and the exemplary embodiments of the spray arm and/or of the dishwasher described below. The spray arm and/or the dishwasher are further explained in greater detail below on the basis of the preferred embodiments with reference to the appended figures.

Elements which are the same or function the same have been provided with the same reference characters in the figures, unless specified otherwise.

DETAILED DESCRIPTION OF EXEMPLARY EMBODIMENTS OF THE PRESENT INVENTION

Figure 1:
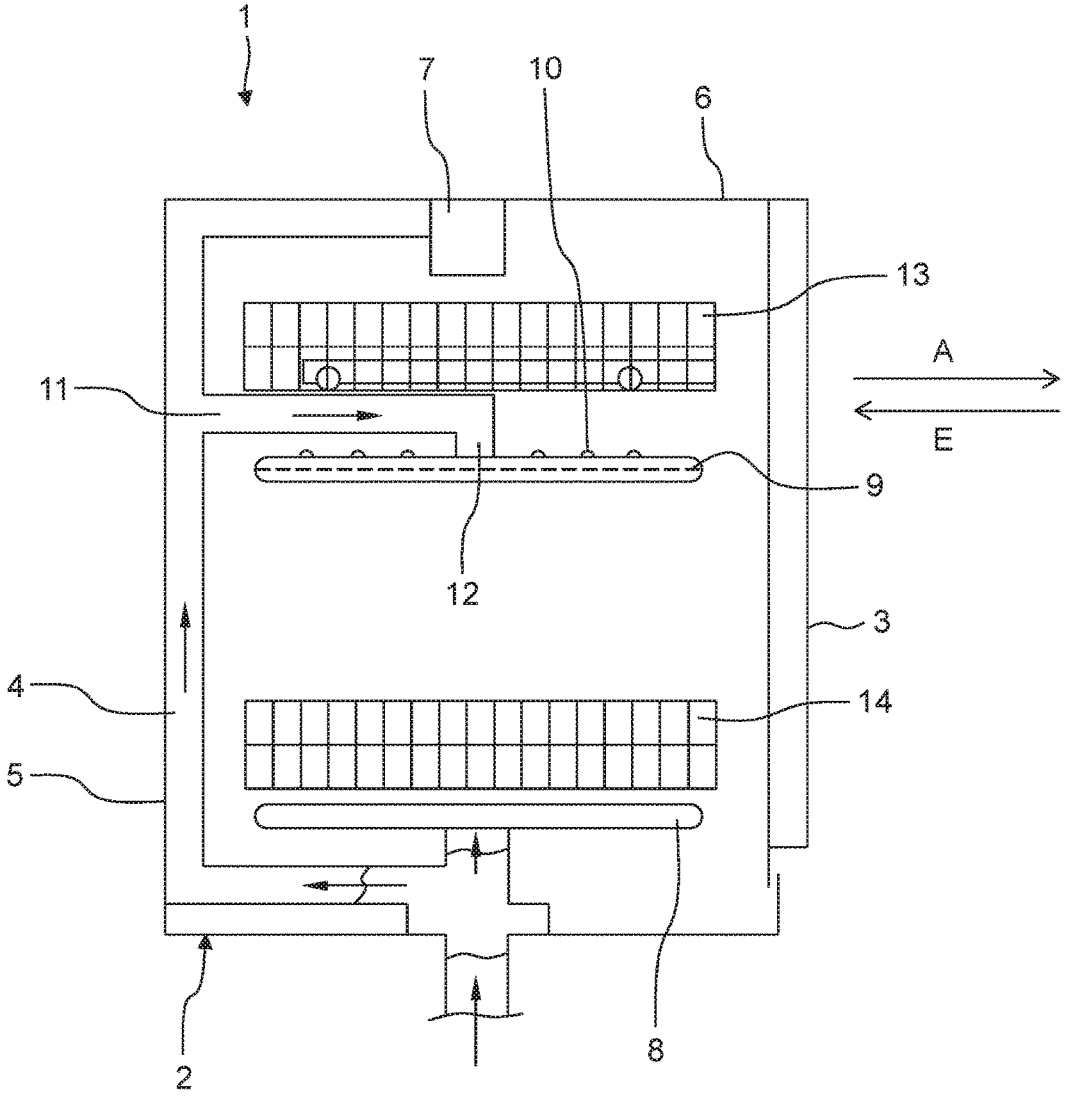
FIG. 1 shows a schematic sectional view of an embodiment of a dishwasher.

FIG. 1 shows a significantly simplified schematic sectional view of an embodiment of a dishwasher 1. The dishwasher 1 is a domestic dishwasher. The dishwasher 1 has a dishwasher cavity 2 which can be enclosed in a water-tight manner by a door 3. A supply pipe 4 is arranged within the dishwasher cavity 2. The supply pipe 4 preferably runs along a rear wall 5 of the dishwasher cavity 2. Washing liquor can be applied to the supply pipe 4 with the aid of a pump (not shown). The supply pipe 4 runs along the rear wall 5 and along a ceiling 6 of the dishwasher cavity 2. A roof spray apparatus 7 which is applied with washing liquor with the aid of the supply pipe 4 is provided on the ceiling 6.

A lower spray arm 8 and an upper spray arm 9 are also provided in the dishwasher cavity 2. The spray arms 8, 9 have spray nozzles 10, of which only one is provided with a reference character in FIG. 1. Spray nozzles provided on the lower spray arm 8 are not shown in FIG. 1. The lower spray arm 8 preferably has spray nozzles arranged only on the top side. The upper spray arm 9 can, in addition to the spray nozzles 10 provided on the top side, also have spray nozzles on the bottom side. The upper spray arm 9 is fastened rotatably on an inlet pipe 11. In particular, the inlet pipe 11 has a curved segment 12, which is curved downward by 90° relative to the inlet pipe 11. The upper spray arm 9 is fastened rotatably on the curved segment 12.

The dishwasher 1 further has at least two receptacles 13, 14 for items to be washed provided in the dishwasher cavity 2. The receptacle 13 for items to be washed can be an upper receptacle for items to be washed or a top basket of the dishwasher 1 and the receptacle 14 for items to be washed can be a lower receptacle for items to be washed or a bottom basket of the dishwasher 1. Furthermore, the dishwasher 1 can have a cutlery basket. The upper spray arm 9 is arranged between the receptacles 13, 14 for items to be washed. The receptacles 13, 14 for items to be washed take the form of a grid or in particular a basket. With the aid of guide devices, not shown in FIG. 1, the receptacles 13, 14 for items to be washed can be taken out of the dishwasher cavity 2 in a pull-out direction A when door 3 is opened and moved back into the dishwasher cavity 2 in an insertion direction E counter to the pull-out direction A. The inlet pipe 11 is preferably fastened to the receptacle 13 for items to be washed. A separable coupling is provided between the inlet pipe 11 and the supply pipe 4 in order to permit a separation of the inlet pipe 11 from the supply pipe 4.

Figure 2:
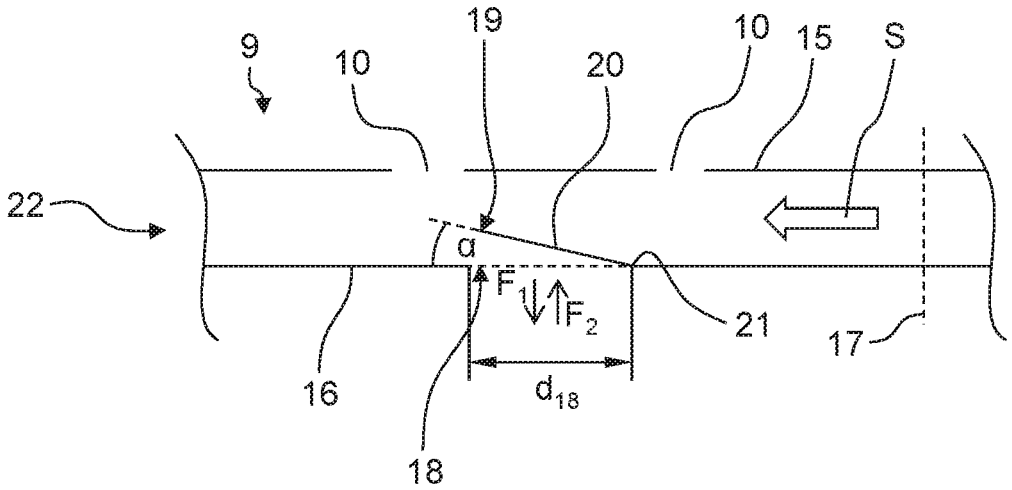
FIG. 2 shows a schematic sectional view of an embodiment of a spray arm for the dishwasher according to FIG. 1.

FIG. 2 shows an embodiment of the upper spray arm 9 in a significantly simplified sectional view. The spray arm 8 can have exactly the same structure as the spray arm 9.

However reference is made below only to spray arm 9. The spray arm 9 is preferably embodied from two horizontally divided shells, in particular a top shell and a bottom shell, which are connected in a fluid-tight manner with one another, in particular fused, glued or welded. The top shell forms an upper wall 15 and the bottom shell forms a lower wall 16 of the spray arm 9. The spray arm 9 is mounted rotatably about an axis of rotation 17 on the inlet pipe 11.

Spray nozzles 10 are provided in the wall 15. Spray nozzles 10 can likewise be provided in the wall 16. At least one outlet nozzle 18 for emptying washing liquor S from the spray arm 9 is provided on the bottom side of the spray arm 9, in other words in the wall 16. The outlet nozzle 18 has a diameter $d_{18}$. The diameter $d_{18}$ is preferably greater than a diameter of the spray nozzles 10.

In particular the diameter $d_{18}$ is greater than 3 mm. For instance the diameter $d_{18}$ can be 4, 5, or 6 mm or more.

A valve 19 for selectively closing or opening the outlet nozzle 18 is provided on the outlet nozzle 18. The valve 19 can be moved from an open position shown in FIG. 2 into a closed position with the aid of a pressure of the washing liquor S. The valve 19 is spring-pretensioned in the direction of the open position so that the valve 19 automatically opens when the pressure of the washing liquor drops below a predetermined value. In particular, the valve 19 opens as soon as the pump no longer pumps washing liquor S into the supply pipe 4.

A rapid and complete emptying of the spray arm 9 is ensured with the aid of the valve 19. This prevents waste water from transferring from one wash segment of the wash cycle of the dishwasher into the next wash segment. The cleaning performance of the dishwasher 1 is increased by reducing this transfer. Furthermore, the drying performance is improved or the level of staining is reduced. This can be achieved in particular by a more rapid and defined emptying process after the rinsing with rinse-aid cycle.

The valve 19 has a plate-shaped valve body 20 and a hinge 21. The hinge 21 can be a film hinge. FIG. 2 shows a force $F_1$ which the washing liquor S applies onto the valve body 20. Furthermore, a force $F_2$ is shown in FIG. 2, which results from the spring pretensioning of the valve body 20 and acts against the force $F_1$. As soon as the force $F_1$ is greater than the force $F_2$, the valve 19 closes on account of the pressure of the washing liquor in the spray arm 9 during the operation of the dishwasher 1. As soon as the force $F_2$ is greater than the force $F_1$, the valve 19 automatically opens since no or only a very low pressure of washing liquor is present in the spray arm 9.

The washing liquor S always flows from the axis of rotation 17, on which a mounting device for mounting the spray arm 9 on the inlet pipe 11 is provided, in the direction of an end segment 22 of the spray arm 9. As FIG. 2 shows, in the open position the valve body 20 is arranged obliquely to the wall 16 of the spray arm 9. For instance, the valve body 20 can be positioned at an angle $\alpha$ obliquely to the wall 16.

The angle $\alpha$ can have a value between 10° and 45°, further preferably between 15° and 40°, further preferably between 20° and 35°. In particular, the plate-shaped valve body 20 points in the direction of the end segment 22 of the spray arm 9. In this way the washing liquor S cannot press open the valve 19.

Figure 3:
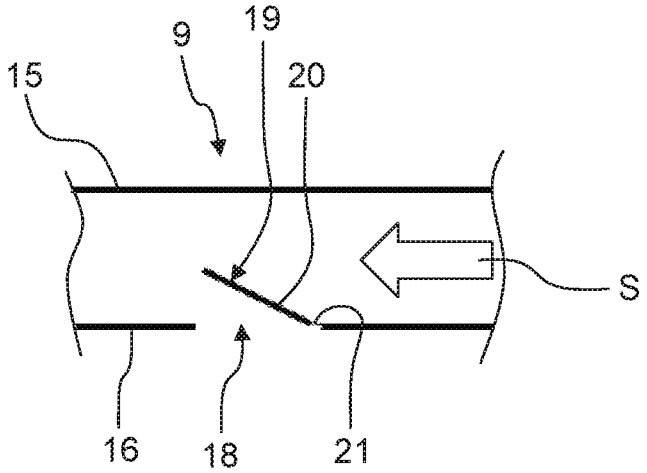
FIG. 3 shows a schematic sectional view of a further embodiment of a spray arm for the dishwasher according to FIG. 1.

FIG. 3 shows a further embodiment of the spray arm 9 in a significantly simplified sectional view. With this embodiment of the spray arm 9, the valve 19 is embodied integrally with the spray arm 9. In particular, the valve body 20 is embodied integrally with the wall 16 of the spray arm 9. The hinge 21 is preferably embodied here as a film hinge. For instance, the spray arm 9 and in particular the bottom shell of the spray arm 9 can be embodied integrally with the valve 19 in a plastic injection-molding process.

Figure 4:
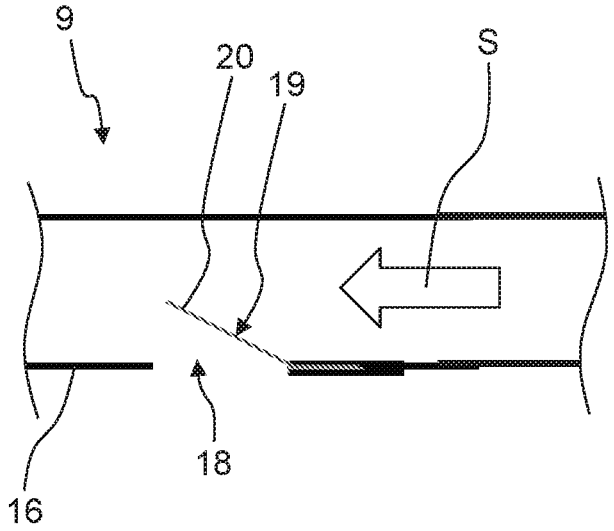
FIG. 4 shows a schematic sectional view of a further embodiment of a spray arm for the dishwasher according to FIG. 1.

FIG. 4 shows a further embodiment of the spray arm 9 in a significantly simplified sectional view. With this embodiment of the spray arm 9, the valve 19 is designed as a shaped insert, which is coated with material of the wall 16 in a plastic injection-molding process. Here the valve body 20 can be embodied from a material which differs from that of the wall 16. For instance, the valve body 20 can be manufactured from a metallic material. In particular, the valve body 20 can be a leaf spring.

Figure 5:
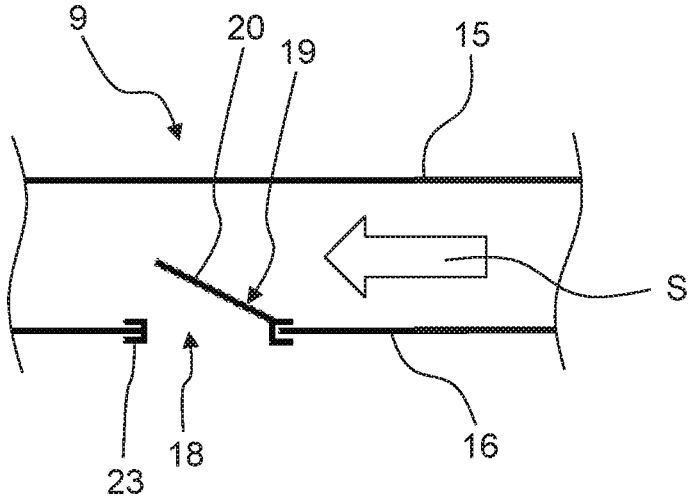
FIG. 5 shows a schematic sectional view of a further embodiment of a spray arm for the dishwasher according to FIG. 1.

FIG. 5 shows a further embodiment of the spray arm 9 in a significantly simplified sectional view. With this embodiment of the spray arm 9, the valve 19 and the spray arm 9 are multi-part. The valve 19 can have a ring-shaped base segment 23, which is snapped into the spray arm 9. In particular, the base segment 23 can be snapped into the outlet nozzle 18. Alternatively, the base segment 23 can also be coated with material of the spray arm 9.

Figure 6:
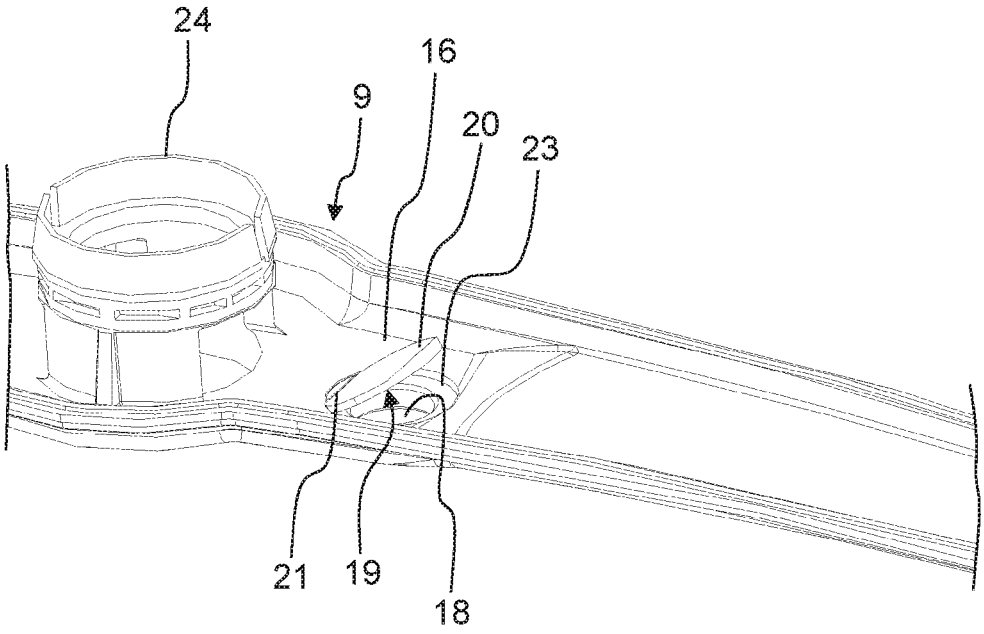
FIG. 6 shows a schematic perspective view of the spray arm according to FIG. 5.
Figure 7:
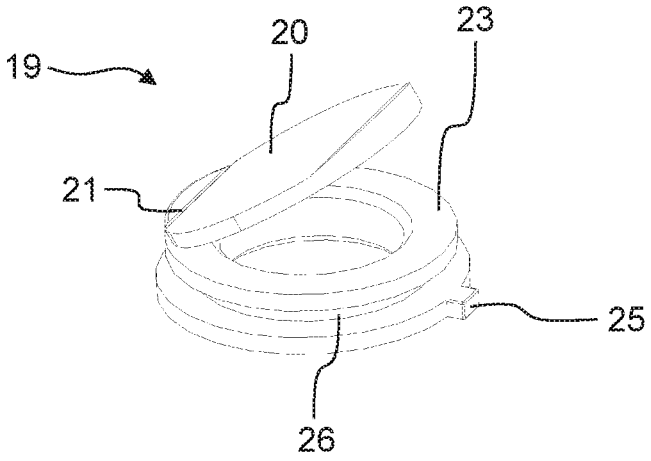
FIG. 7 shows a schematic sectional view of a valve for the spray arm according to FIG. 5.

FIG. 6 shows the embodiment of the spray arm 9 according to FIG. 5 in a schematic perspective view. FIG. 7 shows the valve 19 in a schematic perspective view. Reference is made below simultaneously to FIGS. 6 and 7.

The valve 19 can be manufactured from a spring-elastic deformable silicon material for instance. FIG. 6 also shows a mounting device 24 for mounting the spray arm 9 on the inlet pipe 11. The base segment 23 of the valve 19 has an anti-twist element 25, which prevents the valve 19 from twisting in the outlet nozzle 18. This constantly ensures that the valve body 20 points obliquely in the direction of the end segment 22. The base segment 23 has a circumferential groove 26, into which the wall 16 engages in a form-fit manner. On the spray arm 9 a number of outlet nozzles 18 of this type can be provided with valves 19. The outlet nozzles 18 can be provided on both sides of the mounting device 24 or in the region of the end segment 22 for instance.

With the aid of the outlet nozzle 18, it is possible to improve the emptying of the spray arm 9 as soon as this is unpressurized. By completely emptying the spray arm 9, the transfer of washing liquor S between one wash segment of a wash cycle of the dishwasher 1 to the next can be avoided or at least reduced. For instance, the transfer of waste water from the pre-rinse cycle into the cleaning cycle or from the intermediate rinse cycle into the rinsing with rinse-aid cycle can be prevented. The lower the transfer, the better therefore the cleaning performance of the dishwasher 1.

Furthermore, the drying performance can be improved or the level of staining on the items to be washed can be reduced. This is achieved by the rapid and defined emptying process after the rinsing with rinse-aid cycle. The outlet nozzle 18 preferably has a large diameter compared with the spray nozzles 10. In this way the washing liquor in the spray arm 9 can drain off rapidly and entirely so that the washing liquor does not transfer into the following wash cycle.

As the valve 19 can be closed when pressure is applied, this prevents the pressure of the washing liquor on the spray nozzles 10 from reducing. This maintains the cleaning performance. Since the outlet nozzle 18 is closed during the spray cycle, with an unchanged spray pressure the motor rotation speed and thus the energy consumption of the pump can be reduced. On account of the outlet nozzle 18 being closed during the spray cycle, a smaller total nozzle opening cross-section is achieved. This achieves an energy saving.

Furthermore, as rapid and complete an emptying of the spray arm 9 as possible is ensured, if, after the spray cycle, the outlet nozzle 18 is opened with a large diameter. An improved washing performance can be achieved in this way by the higher hydraulic spray arm removal capacity.

Although the present invention has been described on the basis of exemplary embodiments, it can be modified in a variety of ways.

The invention claimed is:

1. A spray arm for a dishwasher, said spray arm comprising:

an outlet nozzle provided on a bottom side of the spray arm for emptying washing liquor from the spray arm, and a valve provided at the outlet nozzle and configured to selectively close or open the outlet nozzle and movable from an open position, in which the valve projects into an inside of the spray arm, into a closed position in response to a pressure of the washing liquor, said valve being pretensioned in a direction to seek the open position so that the valve automatically opens when the pressure of the washing liquor drops below a predetermined value.

2. The spray arm of claim 1, wherein the valve has a plate-shaped valve body.

3. The spray arm of claim 2, wherein in the open position the plate-shaped valve body is arranged obliquely to a wall of the spray arm.

4. The spray arm of claim 2, wherein the plate-shaped valve body points in a direction of an end segment of the spray arm.

5. The spray arm of claim 1, wherein the valve is embodied integrally with the spray arm.

6. The spray arm of claim 5, wherein the valve has a film hinge which is thinned as compared to the valve and the spray arm to effect pretensioning of the valve.

7. The spray arm of claim 1, wherein the valve and the spray arm are multi-part.

8. The spray arm of claim 7, wherein the valve includes a base segment which is snapped into the spray arm.

9. The spray arm of claim 1, further comprising two of said outlet nozzle, said two outlet nozzles being arranged in spaced-apart relation.

10. The spray arm of claim 9, wherein the two outlet nozzles are arranged on both sides of an axis of rotation of the spray arm.

11. The spray arm of claim 1, wherein the outlet nozzle is closed at least partially, when the valve assumes the closed position.

12. A dishwasher, comprising a spray arm, said spray arm comprising an outlet nozzle provided on a bottom side of the spray arm for emptying washing liquor from the spray arm, and a valve provided at the outlet nozzle and configured to selectively close or open the outlet nozzle and movable from an open position, in which the valve projects into an inside of the spray arm, into a closed position in response to a pressure of the washing liquor, said valve being pretensioned in a direction to seek the open position so that the valve automatically opens when the pressure of the washing liquor drops below a predetermined value.

13. The dishwasher of claim 12, wherein the valve has a plate-shaped valve body.

14. The dishwasher of claim 13, wherein in the open position the plate-shaped valve body is arranged obliquely to a wall of the spray arm.

15. The dishwasher of claim 13, wherein the plate-shaped valve body points in a direction of an end segment of the spray arm.

16. The dishwasher of claim 12, wherein the valve is embodied integrally with the spray arm.

17. The dishwasher of claim 16, wherein the valve has a film hinge which is thinned as compared to the valve and the spray arm to effect pretensioning of the valve.

18. The dishwasher of claim 12, wherein the valve and the spray arm are multi-part.

19. The dishwasher of claim 18, wherein the valve includes a base segment which is snapped into the spray arm.

20. The dishwasher of claim 12, wherein the spray arm includes two of said outlet nozzle, said two outlet nozzles being arranged in spaced-apart relation.

21. The dishwasher of claim 20, wherein the two outlet nozzles are arranged on both sides of an axis of rotation of the spray arm.

22. The dishwasher of claim 12, wherein the outlet nozzle is closed at least partially, when the valve assumes the closed position.

* * * * *